US007083138B2

(12) United States Patent
Elliott et al.

(10) Patent No.: US 7,083,138 B2
(45) Date of Patent: Aug. 1, 2006

(54) TWO ROLL PAPER WEB MATERIAL DISPENSER

(75) Inventors: Adam T. Elliott, Lexington, KY (US); Daniel J. Knight, Nicholasville, KY (US)

(73) Assignee: Bay West Paper Corporation, Harrodsburg, KY (US)

( * ) Notice: Subject to any disclaimer, the term of this patent is extended or adjusted under 35 U.S.C. 154(b) by 88 days.

(21) Appl. No.: 10/767,707

(22) Filed: Jan. 29, 2004

(65) Prior Publication Data

US 2005/0167543 A1 Aug. 4, 2005

(51) Int. Cl.
*B65H 19/00* (2006.01)

(52) U.S. Cl. ..... 242/560; 242/597.5; 242/597.8

(58) Field of Classification Search ..... 242/560, 242/597.5, 597.8, 597; 312/34.22
See application file for complete search history.

(56) References Cited

U.S. PATENT DOCUMENTS

| | | | | |
|---|---|---|---|---|
| 2,805,030 | A | 9/1957 | Wolters | |
| 2,908,450 | A | 10/1959 | Stone et al. | |
| 3,010,670 | A | 11/1961 | Jones et al. | |
| 3,126,164 | A | 3/1964 | Perrin | |
| 3,184,176 | A | 5/1965 | Tucker et al. | |
| 3,211,504 | A | 10/1965 | Bump | |
| 3,381,909 | A | 5/1968 | Tucker et al. | |
| 3,387,902 | A | 6/1968 | Perrin et al. | |
| 3,584,802 | A | 6/1971 | Sieber | |
| 3,656,699 | A | 4/1972 | Schnyder et al. | |
| 4,025,004 | A | 5/1977 | Massey | |
| 4,098,469 | A * | 7/1978 | McCarthy | 242/560.3 |
| 4,307,639 | A | 12/1981 | DeLuca | |
| 4,522,346 | A | 6/1985 | Jespersen | |
| 4,998,681 | A | 3/1991 | McNeill | |
| 5,265,816 | A | 11/1993 | Collins | |
| 5,628,474 | A | 5/1997 | Krueger et al. | |
| 5,697,576 | A | 12/1997 | Bloch et al. | |
| 5,749,538 | A * | 5/1998 | Brown et al. | 242/559.2 |
| 5,813,624 | A | 9/1998 | Grasso et al. | |
| 5,868,342 | A | 2/1999 | Moody et al. | |
| 6,036,134 | A | 3/2000 | Moody | |
| 6,092,758 | A | 7/2000 | Gemmell | |
| 6,092,759 | A | 7/2000 | Gemmell et al. | |
| 6,202,956 | B1 | 3/2001 | Grasso et al. | |
| 6,360,985 | B1 | 3/2002 | Phelps et al. | |
| 6,439,502 | B1 | 8/2002 | Gemmell et al. | |

(Continued)

FOREIGN PATENT DOCUMENTS

| | | |
|---|---|---|
| CH | 648 739 A5 | 4/1985 |

*Primary Examiner*—John Q. Nguyen
(74) *Attorney, Agent, or Firm*—Merchant & Gould P.C.

(57) ABSTRACT

Improvements to paper web material dispensers, particularly two roll tissue dispensers. A dispenser according to the invention is able to prevent access to a second or reserve roll of tissue until a first or dispensing roll is entirely or substantially depleted. As a result, the tissue of the first roll must be used up, or substantially used up, before tissue from the second roll can be used, thereby avoiding tissue waste. The dispenser of the invention can be used with reduced core tissue rolls, where each roll has first and second core sections that are spaced apart from each other to form a gap between facing ends thereof so that the total length of the core sections is less than the width of the tissue wound onto the core sections. The dispenser of the invention thus encourages the use of reduced core tissue rolls, which results in a reduction of waste resulting from used tissue cores.

20 Claims, 9 Drawing Sheets

U.S. PATENT DOCUMENTS 6,491,251 B1 12/2002 Stanland et al.

6,648,267 B1 11/2003 Stanland et al.

* cited by examiner

TWO ROLL PAPER WEB MATERIAL DISPENSER

FIELD OF THE INVENTION

The invention disclosed herein relates to the dispensing of paper web material, such as toilet tissue or paper towel, from at least one roll of paper web material contained within a dispenser. More particularly, the invention disclosed herein relates to a dispenser that contains a plurality of rolls of paper web material, where the first roll must be completely depleted or substantially depleted before a second roll that is held in reserve can be brought into position to dispense web material. The inventive concepts will be described hereinafter primarily in relation to toilet tissue dispensers and dispensing tissue from toilet tissue rolls. It is to be realized that the inventive concepts described herein have applications to other types of paper web materials in addition to toilet tissue, including, but not limited to, paper towels.

BACKGROUND OF THE INVENTION

There has been continuing effort over the years to provide toilet tissue dispensers that store multiple rolls of toilet tissue and that sequentially dispense the rolls. One of the advantages provided by these types of dispensers is that a reserve roll (or rolls) is available as a replacement for the roll that is currently in use. To avoid tissue waste, it is desirable that the roll currently in use be completely or substantially depleted before allowing the user to access a replacement roll.

As an example, the use of tissue dispensers that hold two tissue rolls, with one roll dispensing tissue and the second roll being held in reserve so that it can dispense tissue when the first roll is completely or substantially depleted, is well known. These types of dispensers are often employed in commercial, industrial and public settings, and in other institutional environments. Examples of two roll dispensers are disclosed in U.S. Pat. Nos. 6,439,502, 6,202,956, 5,813,624, 5,628,474, 4,522,346, 4,422,585, 3,387,902, and 3,381,909.

Toilet tissue rolls and other paper roll products, such as paper towel rolls, typically comprise a paper web material that is wound around a central core. The core helps to support the paper web material and define the shape of the roll, as well as define a central opening for interaction with a support structure, such as a mandrel, on a suitable dispensing apparatus.

In many paper roll products, the core is a one piece structure that extends the entire width of the roll product. However, in some known paper roll products, the core is formed by core sections that are spaced apart from each other to form a gap therebetween so that the total length of the core sections is less than the width of the web material wound onto the core sections. These reduced core paper roll products having spaced core sections separated by a gap help to reduce the amount of core stock material that is used, thereby reducing material waste and production costs. Examples of reduced core paper roll products are disclosed in U.S. Pat. Nos. 6,648,267 and 6,491,251.

There is a continuing need for improved paper web material dispensers, for example two roll tissue dispensers. Moreover, to encourage use of the more environmentally friendly reduced core paper web material rolls, there is a need for a paper web material dispenser, for example a two roll tissue dispenser, which is designed for use with reduced core paper web material rolls.

SUMMARY OF THE INVENTION

The invention relates to improvements to paper web material dispensers, particularly two roll tissue dispensers. A dispenser according to the invention is able to prevent access to a second or reserve roll of paper web material until a first or dispensing roll is entirely or substantially depleted. As a result, the web material of the first roll must be used up, or substantially used up, before web material from the second roll can be used, thereby avoiding waste.

The dispenser of the invention can be used with reduced core paper web material rolls, where each roll has first and second core sections that are spaced apart from each other to form a gap between facing ends thereof so that the total length of the core sections is less than the width of the web material wound onto the core sections. The dispenser of the invention thus encourages the use of reduced core web material rolls, which results in a reduction of waste resulting from used cores.

In accordance with a first aspect of the invention, a dispenser for dispensing paper web material from rolls of paper web material comprises a housing having a front cover and a rear housing defining a housing interior. The front cover includes opposite end walls, an opening that communicates the housing interior with the exterior, and a door slideably supported in a portion of the opening and slideable between a first door position and a second door position. First and second roll support mechanisms are disposed within the housing interior, with each roll support mechanism including a mandrel upon which a paper web material roll is to be supported, and each mandrel being movable in a direction toward one of the end walls of the front cover.

In another aspect of the invention, a dispenser for dispensing paper web material from reduced core paper web material rolls, where each roll has a core formed by first and second spaced apart core sections, comprises a housing having a front cover and a rear housing defining a housing interior. The front cover includes opposite end walls, and an opening that communicates the housing interior with the exterior. A door is slideably supported in a portion of the opening and is slideable between a first door position and a second door position. First and second roll support mechanisms are disposed within the housing interior, with each roll support mechanism including a mandrel upon which a reduced core roll is able to be supported. The mandrels faces in opposite directions and each mandrel has a free end projecting toward a respective end wall of the front cover. Each mandrel is sized such that when a reduced core roll is disposed thereon, the second core section overhangs the free end of the mandrel. In addition, each mandrel is movable in a direction toward the respective end wall of the front cover, whereby when a roll becomes depleted and a mandrel supporting the depleted roll moves toward the respective end wall, engagement between the second core section and the respective end wall forces the second core section toward the first core section.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DESCRIPTION OF THE DRAWINGS

These and other features of the invention will now be described with reference to the drawings of preferred embodiments, which are intended to illustrate and not to limit the invention and in which.

DETAILED DESCRIPTION OF THE INVENTION

Figure 1:
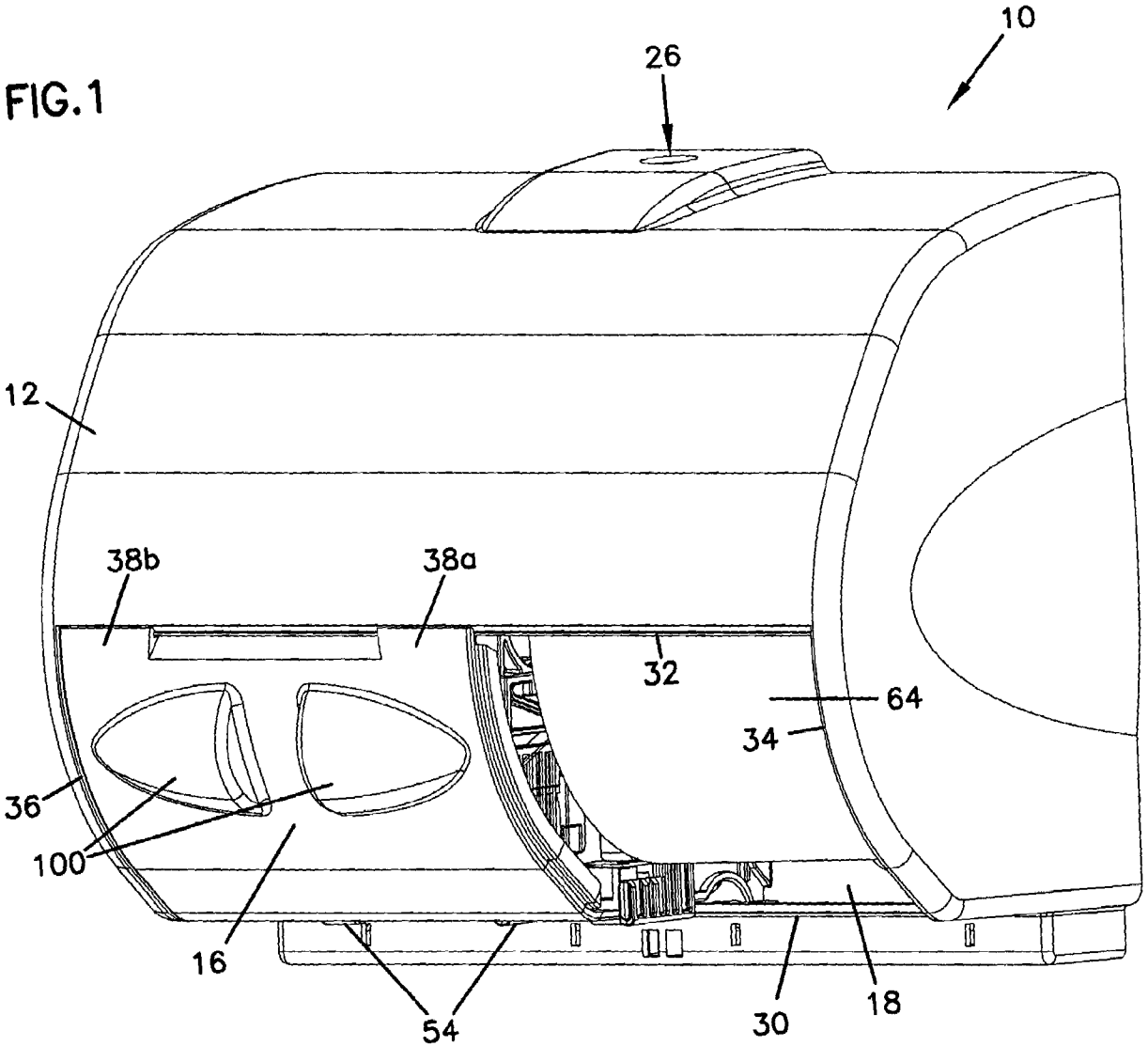
FIG. 1 is a perspective view of a two roll dispenser in accordance with the invention.

With reference to FIG. 1, a dispenser 10 that incorporates the concepts of the invention is illustrated. The dispenser 10 is illustrated as a two roll toilet tissue dispenser. In the two roll tissue dispenser 10 described herein, when two tissues rolls are in the dispenser 10, a first roll is accessible for dispensing tissue while the second roll is generally inaccessible until the first roll is completely depleted or substantially depleted. Once the first roll is completely depleted or substantially depleted, the dispenser then permits access to the second roll so that it can dispense tissue. While the dispenser 10 is described as a two roll toilet tissue dispenser, the concepts described herein can be used on dispensers that dispense other types of paper web material, such as paper towel dispensers. Therefore, paper web material is meant to include toilet tissue and paper towel.

The terms completely depleted and substantially depleted as used in this patent application mean all or a sufficient amount of tissue has been removed from a roll to allow transfer to the second roll. For sake of convenience, the term depleted will hereinafter be used, it being understood that this term encompasses both complete depletion of tissue as well as depletion to an extent that permits transfer to the second roll.

The dispenser 10 comprises a housing formed by a front cover 12, a rear housing 14, and a door 16 that together define a housing interior. The rear housing 14 is configured for attachment to a wall or other support surface. The front cover 12 is pivotally connected to the rear housing 14 for pivoting movement relative to the rear housing between a closed position, shown in FIG. 1, and an open position, shown in FIGS. 2 and 3. The front cover 12 includes an opening 18 that provides access to the housing interior and the tissue rolls held therein, and the door 16 is slideably attached to the front cover 12 in the opening 18 for sliding movements between a first door position (shown in FIG. 1), and a second door position (shown in FIG. 8).

Figure 2:
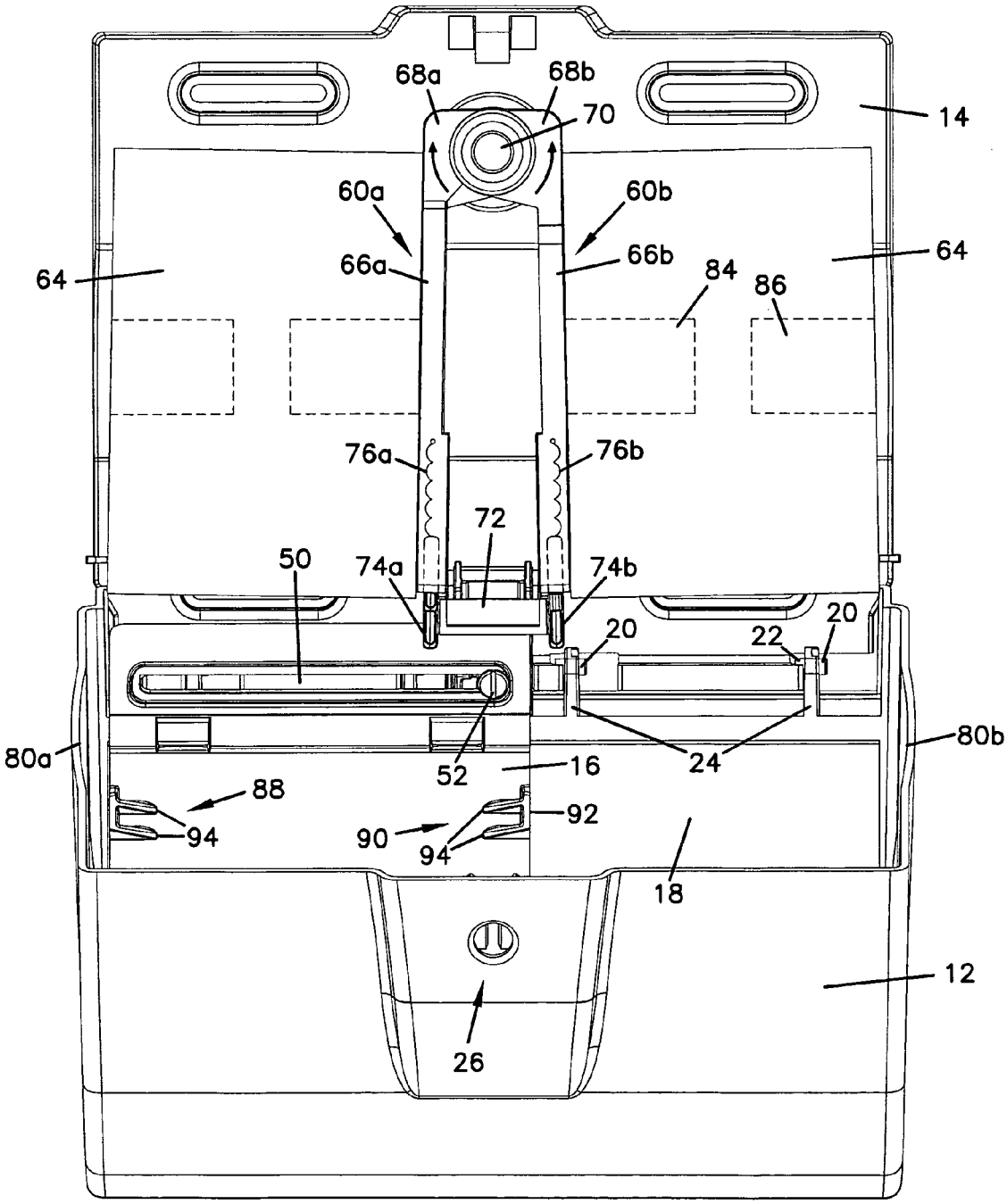
FIG. 2 is a front view of the dispenser with the front cover opened to show two rolls held in the dispenser.
Figure 4:
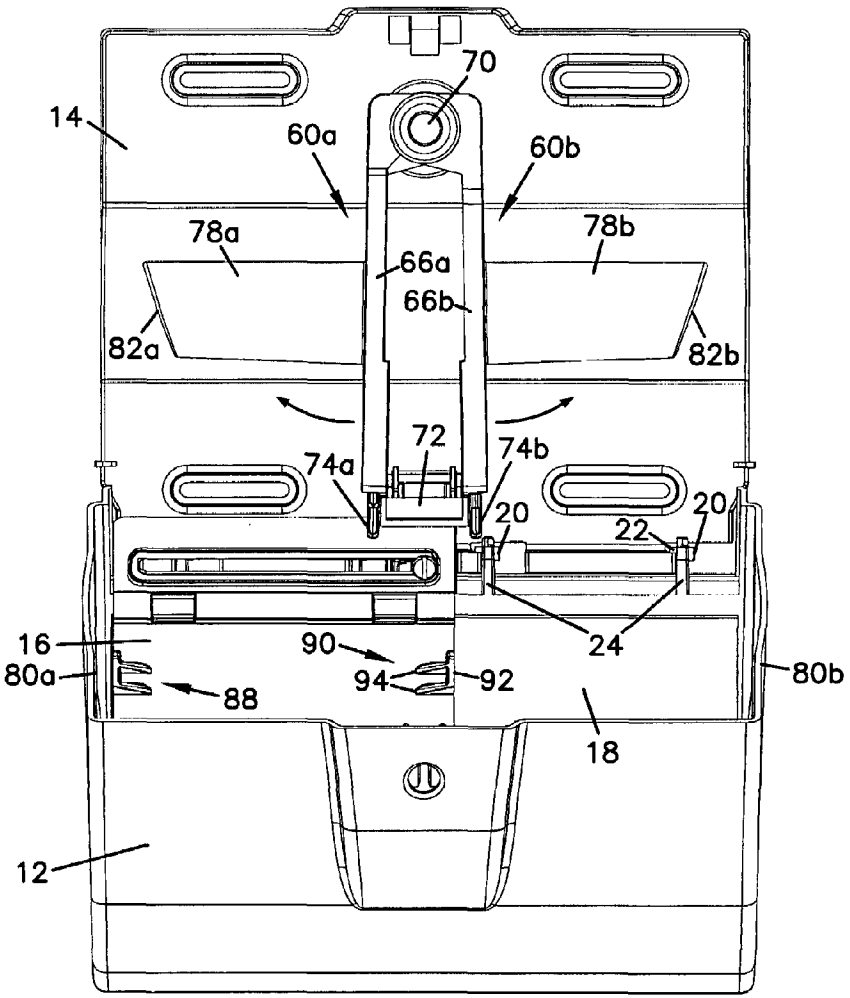
FIG. 4 is front view of the dispenser with the front cover opened, with the two rolls removed to show the roll support mandrels.
Figure 3:
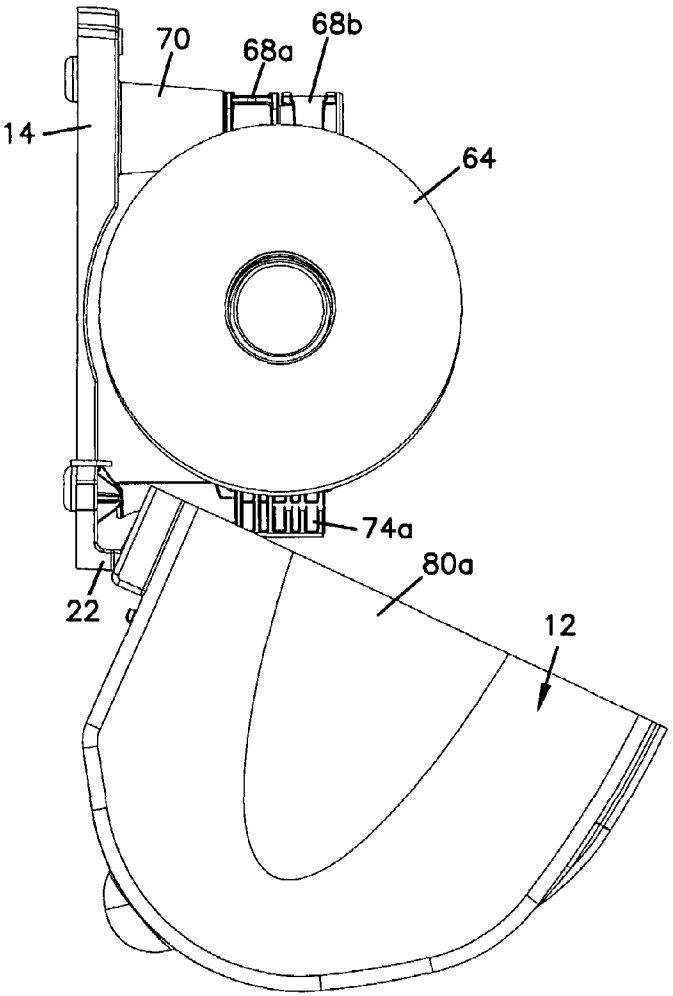
FIG. 3 is a side view of the dispenser with the front cover open.

Pivotal attachment of the front cover 12 to the rear housing 14 is provided by a plurality of spaced pivot pins 20 that are fixed to flanges 22 projecting forwardly from the rear housing 14, as shown in FIGS. 2–4. The front cover 12 includes flanges 24, shown in FIGS. 2, 4, and 5, with holes that receive the pivot pins 20 for pivotally attaching the front cover 12, and the door 16, to the rear housing 14. Only two sets of pivot pins 20, flanges 22, and flanges 24 are visible in the figures. However, an additional two sets of pivot pins 20, flanges 22 and flanges 24 are used on the left side of the housing (when viewing FIG. 2), for pivotally connecting the front cover 12 to the rear housing 14.

The cover 12 is pivoted to the open position to permit access to the housing interior for, e.g., loading tissue rolls into the dispenser 10. During use of the dispenser 10, the cover 12 is at the closed position, and a suitable locking mechanism 26 is provided to maintain the cover at the closed position and deter access to the housing interior.

Figure 5:
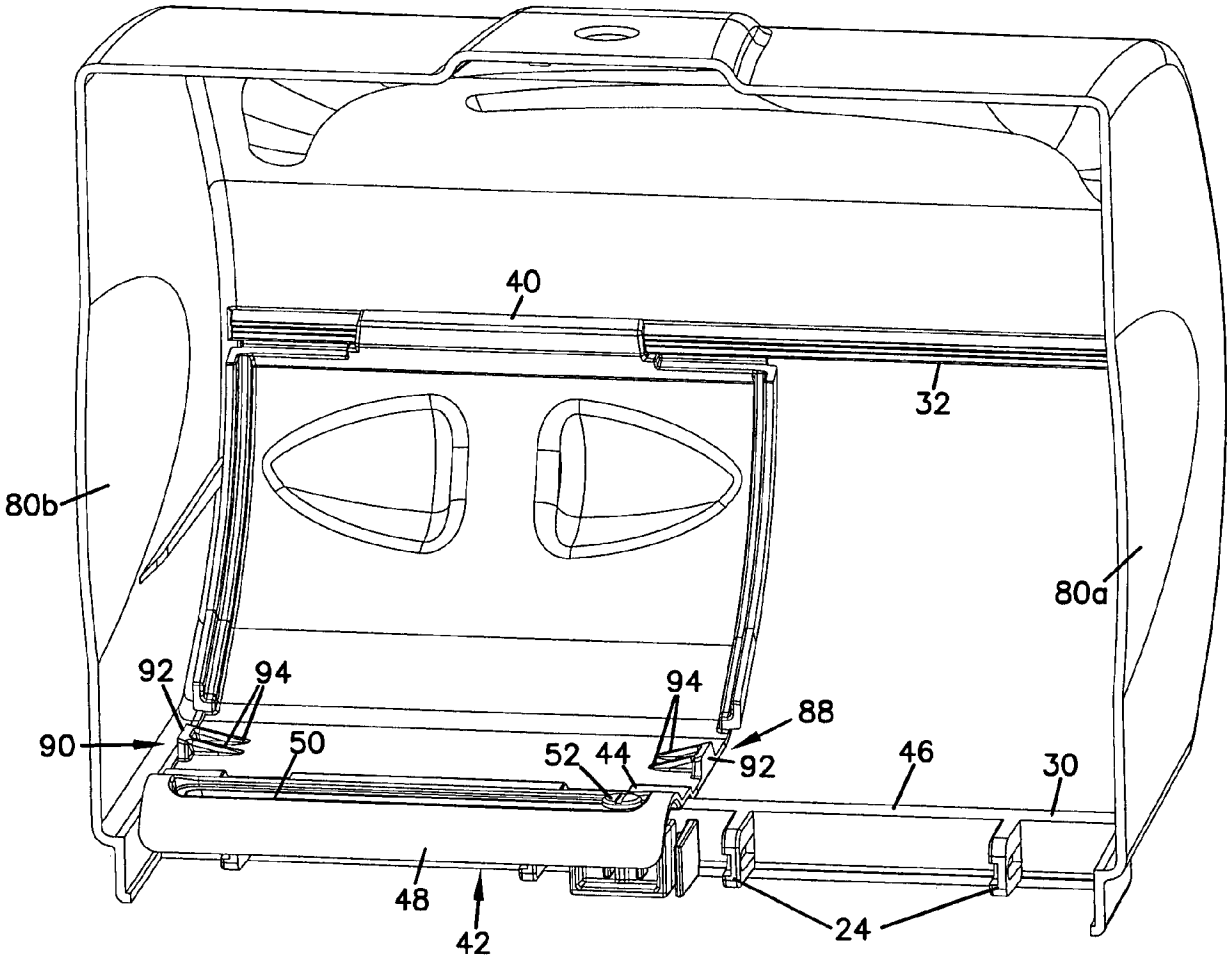
FIG. 5 is rear perspective view of the front cover and door, with the back housing removed, illustrating details of how the door is retained on the front cover.

With reference to FIGS. 1 and 5, the opening 18 includes a bottom edge 30, a top edge 32, a right side edge 34, and a left side edge 36. The door 16 includes a top edge that has front ribs 38*a*, 38*b* and a back rib 40. The ribs 38*a*, 38*b*, 40 hold the top edge 32 of the opening 18 therebetween and permit the top edge of the door 16 to slide relative to the front cover 12 between the first and second door positions. The ribs 38*a*, 38*b*, 40 also prevent the top edge of the door from being pushed inwardly and outwardly relative to the opening 18.

The bottom edge of the door 16 comprises a slide portion 42 that slideably supports the bottom edge of the door 16 on the front cover 12, as shown in FIGS. 2, 4 and 5. The slide portion 42 includes a generally flat front portion 44 that is slideably supported on a flat portion 46 of the bottom edge 30 of the opening. The slide portion 42 also includes an arcuate rear portion 48 that has a slot 50 extending the majority of the length thereof. A retainer 52 (shown in FIGS. 2 and 4) is fixed to the front cover 12 and projects upwardly from the cover 12 and through the slot 50. The slot 50 permits the door 16 to slide relative to the cover 12 between the first and second door positions, with the retainer 52 remaining stationary. The retainer 52 also prevents the bottom edge of the door 16 from being pulled forwardly through the front of the opening 18. To prevent the bottom edge of the door 16 from being pushed further inwardly into the opening 18, the bottom edge of the door 16 also comprises a pair of flanges 54 (which are partially visible in FIG. 1) that engage with and slide on the forward facing surface of the cover 12 adjacent the bottom edge 30 of the opening 18.

As shown in FIG. 1, the door 16 also includes a pair of projections 100 that are spaced from each other. The projections 100 form handles and provide a means by which a user's finger or fingers can grip the door 16 to facilitate movements of the door between the first and second door positions.

Figure 7:
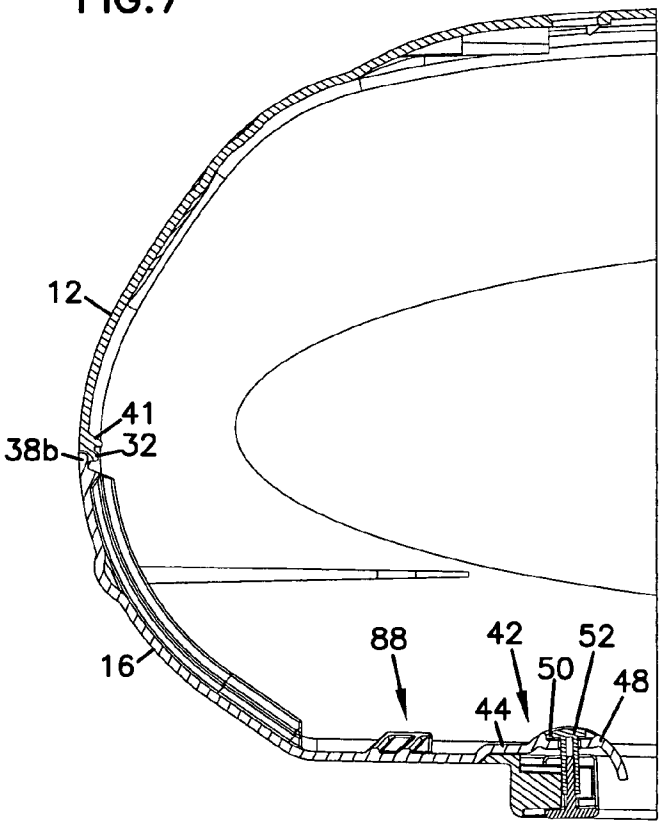
FIG. 7 is a cross-sectional view along line 7—7 of FIG. 6.
Figure 6:
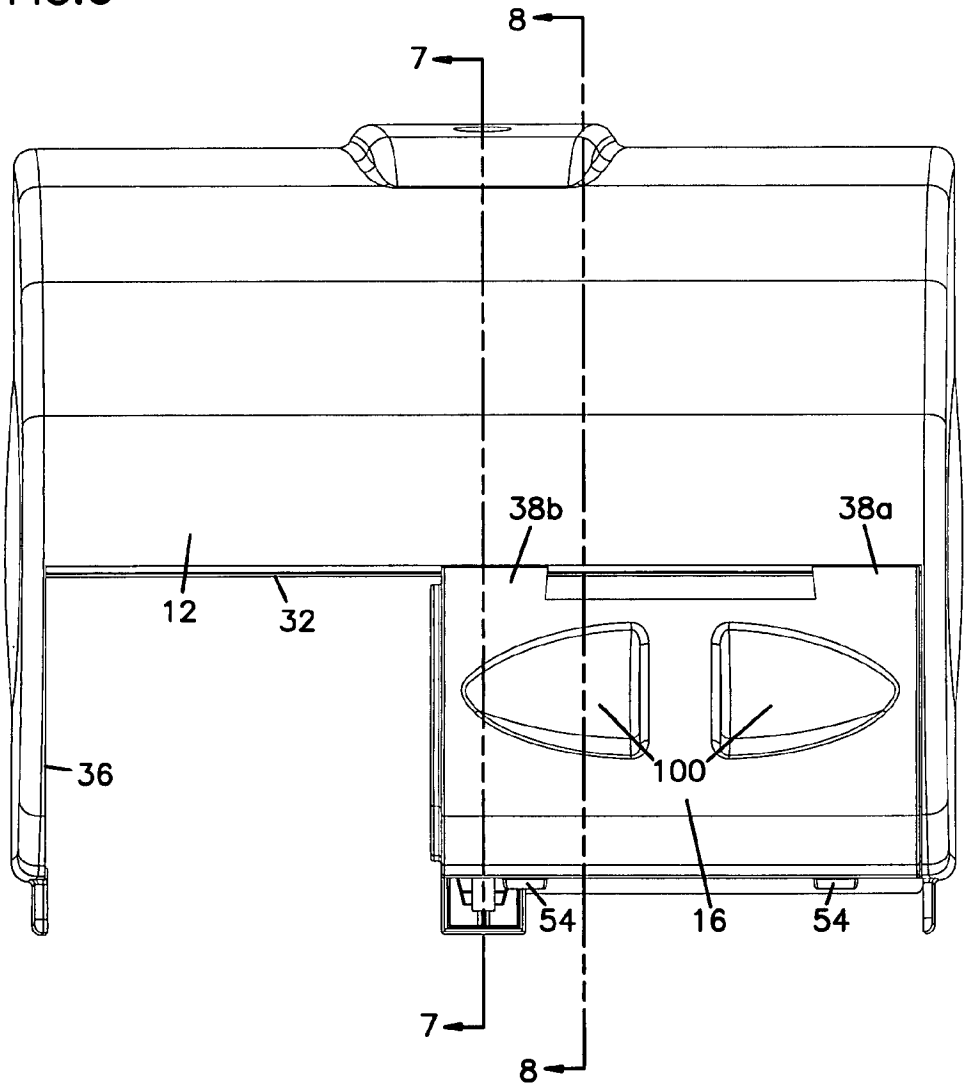
FIG. 6 is a front plan view of the front cover and door.
Figure 8:
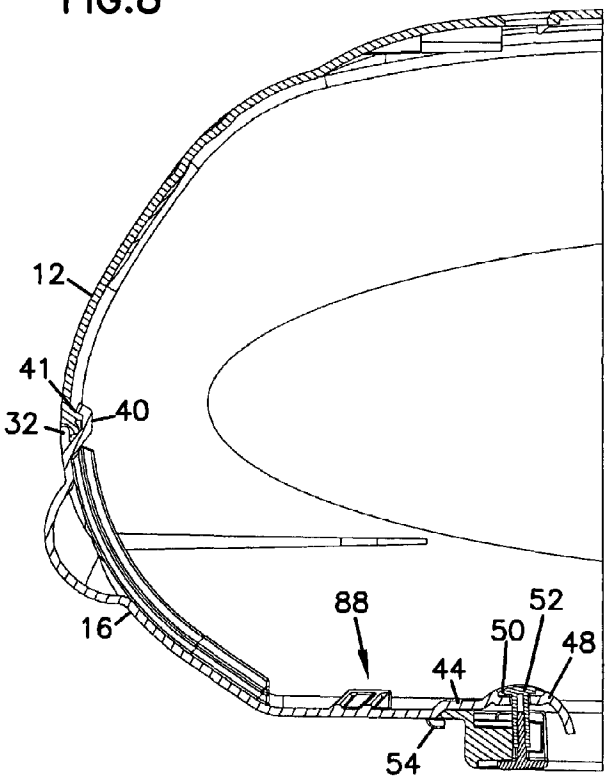
FIG. 8 is a cross-sectional view along line 8—8 of FIG. 6.

FIGS. 6–8 illustrate details of the top and bottom edges of the door 16. The engagement between the rib 38*b* and the top edge 32 of the opening 18 is seen in FIG. 7. In addition, FIG.

7 shows the slide portion 42 in detail, with the retainer 52 engaging with the slot 50. FIG. 8 illustrates details of the engagement between the back rib 40 and the top edge 32 of the opening 18. The interior surface of the front cover 12 includes a ledge 41 upon which the back rib 40 is slideably supported. One of the flanges 54 at the bottom edge of the door 16 is also visible in FIG. 8.

With reference now to FIGS. 2–4, a pair of roll support mechanisms 60*a*, 60*b* each of which supports a tissue roll 64 in the dispenser 10, are illustrated. The support mechanisms 60*a*, 60*b* are similar in construction, with the mechanism 60*a* being configured to support a tissue roll 64 on the left side of the dispenser 10 and the mechanism 60*b* being configured to support a tissue roll 64 on the right side of the dispenser 10. The support mechanisms 60*a*, 60*b* are configured to interact with the door 16 to prevent movement of the door from the first door position to the second door position until the tissue roll that is at the dispensing position is depleted.

Each roll support mechanism 60*a*, 60*b* includes a mandrel arm 66*a*, 66*b* having an apertured end 68*a*, 68*b*. The apertured ends 68*a*, 68*b* fit onto the end of a pivot shaft 70 that is fixed to and projects forwardly from the rear housing 14, as shown in FIG. 3. The ends 68*a*, 68*b* are supported on the pivot shaft 70 so that the arms 66*a*, 66*b* are able to freely pivot about the shaft 70. A gap is provided between the facing surfaces of the arms 66*a*, 66*b*, and a stop 72 projects forwardly from the rear housing to limit movement of the arms 66*a*, 66*b* toward each other and maintain the gap therebetween. The stop 72 engages with tabs 74*a*, 74*b* that are disposed at the bottom end of the arms 66*a*, 66*b*. The tabs 74*a*, 74*b* have lower ends that extend from the arms 66*a*, 66*b* and upper ends that extend inside the arms 66*a*, 66*b*, as illustrated in dashed lines in FIG. 2. A spring 76*a*, 76*b*, shown in dashed lines in FIG. 2, within each arm 66*a*, 66*b* bias the tabs 74*a*, 74*b* downwardly so that the tabs 74*a*, 74*b* engage opposite sides of the stop 72. The stop 72 is sized so that the arms 66*a*, 66*b* are oriented generally vertically during normal operation, as shown in FIG. 2.

With reference to FIG. 4, mandrel 78*a*, 78*b* are fixed to and project from each arm 66*a*, 66*b* at right angles to the axis of the respective arm 66*a*, 66*b*. When the front cover 12 is at its closed position, the mandrels 78*a*, 78*b* also project toward respective end walls 80*a*, 80*b* of the front cover 12. The mandrels 78*a*, 78*b* have free ends 82*a*, 82*b* that are sloped or angled from top to bottom as shown in FIG. 4. The purpose of the sloped ends 82*a*, 82*b* will become apparent later in the description.

The mandrels 78*a*, 78*b* support the tissue rolls 64 during use, so the size of the mandrels should be chosen to permit the core of the tissue roll to fit over the mandrel 78*a*, 78*b* and permit rotation of the core relative to the mandrel when tissue is being pulled from the roll. As discussed above, increasing use is being made of reduced core paper roll products. The dispenser 10 of this invention is particularly designed for use with reduced core tissue rolls. The rolls 64 illustrated in FIG. 2 are reduced core tissue rolls, with each roll 64 having first and second core sections 84, 86 (shown in dashed lines) that are spaced apart from each other to form a gap between facing ends thereof so that the total length of the core sections is less than the width of the tissue wound onto the core sections.

Returning again to FIGS. 2, 4 and 5, the surface of the door 16 that faces the interior of the housing when the front cover 12 is closed is provided with a pair of stops 88, 90 integrally formed therewith. Each stop 88, 90 includes a generally vertical stop surface 92 that faces toward the respective end walls 80*a*, 80*b*, and a ramp surface 94. The stops 88, 90 are designed to interact with the tabs 74*a*, 74*b* on the arms 66*a*, 66*b* to prevent movement of the door 16 from the first door position to the second door position until the tissue roll 64 that is at the dispensing position is depleted.

The operation of the dispenser 10 will now be described. With reference initially to FIG. 1, assume that a pair of full tissue rolls 64 are present in the dispenser 10 mounted on the mandrels 78*a*, 78*b*. In addition, assume that the door 16 is at the position shown in FIG. 1 and that this position is the first door position, and that the tissue roll visible in FIG. 1 is the dispensing roll and the tissue roll that is not visible is a reserve roll with access thereto prevented by the door 16. Assume as well that the door 16 positioned at the opposite end of the opening covering the dispensing roll would be the second door position.

Figure 9:
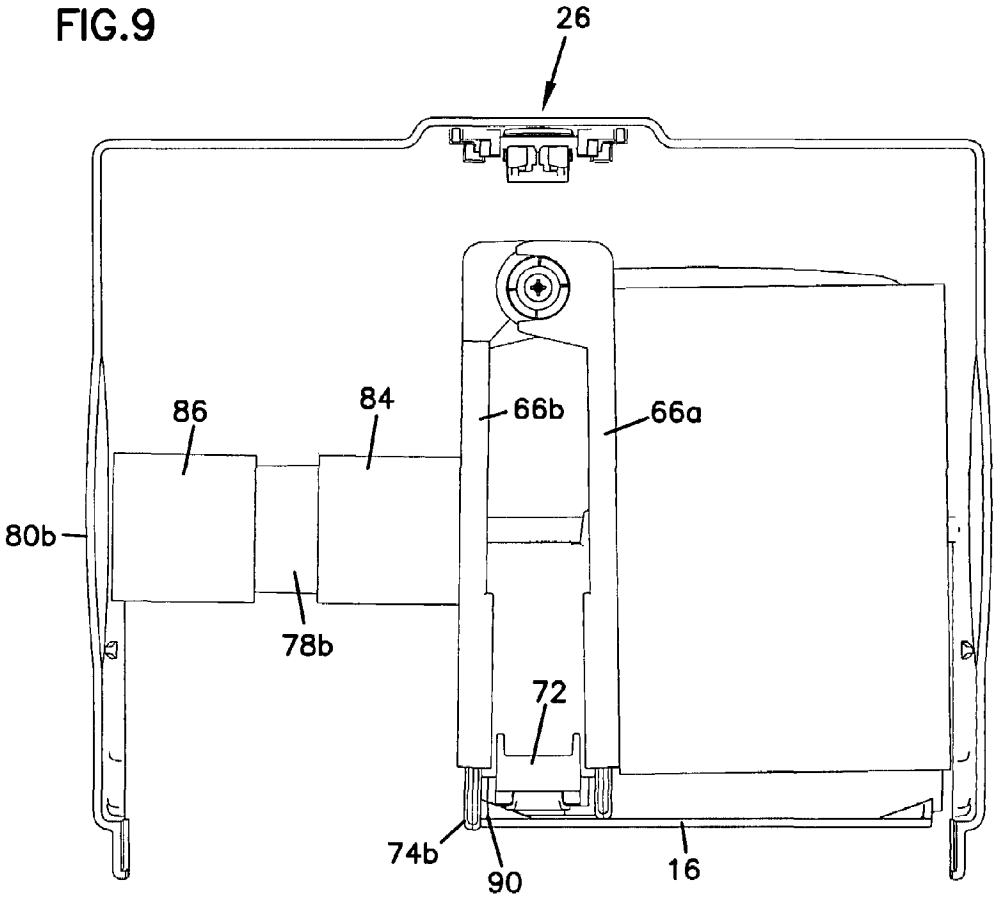
FIG. 9 is a rear view of the front cover and door, with the back housing removed, at a first stage of transfer to access the second roll.

With the configuration in FIG. 1, a user is able to access tissue from the dispensing roll. If the user tries to slide the door 16 to the second door position, the stop surface 92 of the stop 90 (see FIG. 2) would engage the portion of the tab 74*b* that extends below the stop 72, thereby applying a force to the mandrel arm 66*b* tending to rotate the arm 66*b* in a counterclockwise direction about the pivot 70. However, rotation of the arm 66*b* is limited by engagement between the tissue remaining on the dispensing roll and the end wall 80*b* of the front cover 12. As long as sufficient tissue remains on the dispensing roll, the arm 66*b* will not rotate a sufficient amount to permit the stop 90 to pass under the tab 74*b*. However, once the dispensing roll becomes sufficiently depleted, the arm 66*b* is able to rotate counterclockwise a sufficient amount to permit the stop 90 to pass under the tabs 74*b*. FIG. 9 illustrates the dispenser from the rear without the rear housing 14, with the tissue on the dispensing roll being depleted. This is considered the first stage of transfer for accessing the reserve roll, at which the door 16 is first able to be moved to the second door position to uncover the reserve roll.

Figure 10:
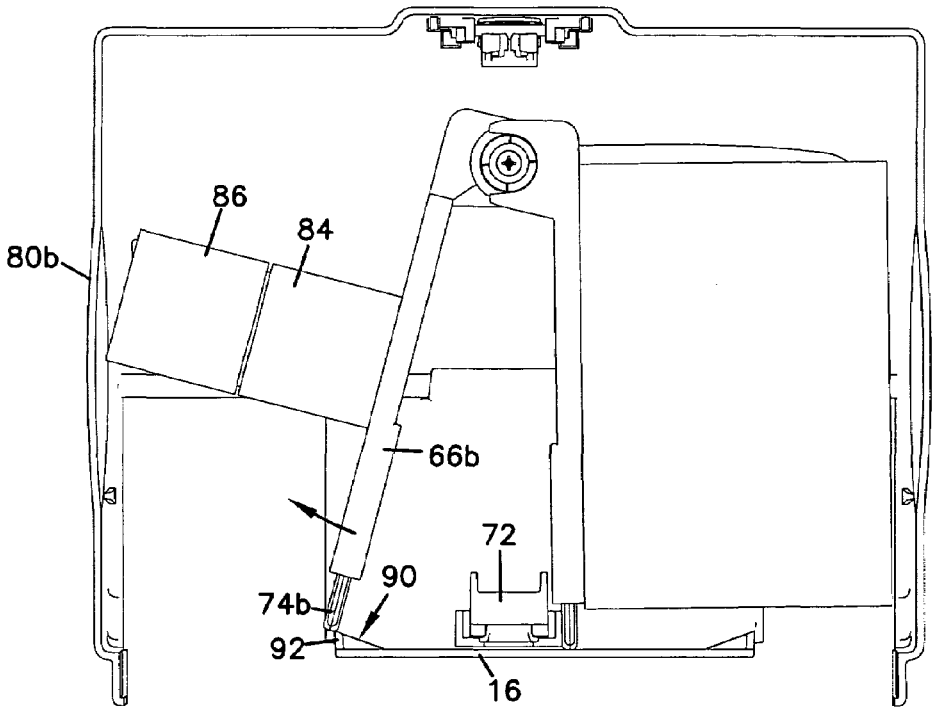
FIG. 10 is a view similar to FIG. 9, showing a second stage of transfer to access the second roll.

FIG. 10 illustrates a second transfer stage for accessing the reserve roll. As the door 16 is pushed toward the second door position (i.e. to the left in FIG. 10), engagement between the stop surface 92 and the tab 74*b* rotates the mandrel arm 66*b* about the pivot 70. As the mandrel arm 66*b* rotates, the mandrel 78*b* moves toward the end wall 80*b*, and the outer core section 86 will hit the end wall 80*b* which forces the core section 86 toward the core section 84 on the mandrel 78*b*. The sloped end 82*b* of the mandrel 78*b* prevents interference between the mandrel 78*b* and the end wall 80*b* during rotation of the arm 66*b*. This permits the mandrel arm 66*b* to rotate a sufficient amount to permit the stop 90 to pass under the tab 74*b*. Once this occurs, the mandrel arm 66*b* then swings back to its home position under the force of gravity with the tab 74*b* engaging the stop 72.

As evident from FIG. 10, the length of each mandrel 78*a*, 78*b* is approximately equal to the length of the two core sections 84, 86. Therefore, when a roll is disposed on a mandrel 78*a*, 78*b*, an end portion of the roll will overhang the end of the mandrel. Such a configuration provides adequate support for the tissue roll, while permitting the core section 86 to be forced toward the core section 84 without the end of the mandrel engaging the end wall 80*b* of the front cover. The end wall 80*b* (and the end wall 80*a*) could be a wall that forms a portion of the exterior of the front cover 12, or the end wall could be a wall that is provided in the dispenser for the purpose of engaging with the core section 86.

It is to be noted that rotation of the mandrel arm 66*b* to permit the stop 90 to clear the tab 74*b* is facilitated by the use of a reduced core tissue roll. If a standard, single core tissue roll were used, one end of the core would abut against the end wall 80*b* while the other end would be against the mandrel arm 66*b*. Although a single core could be crushed sufficiently to permit transfer to the second roll, the force required to crush a single core exceeds 20 pounds, which is over American With Disability Act (ADA) guidelines. Further, applying the necessary crushing force is difficult to do, and could result in damage to the dispenser.

Figure 11:
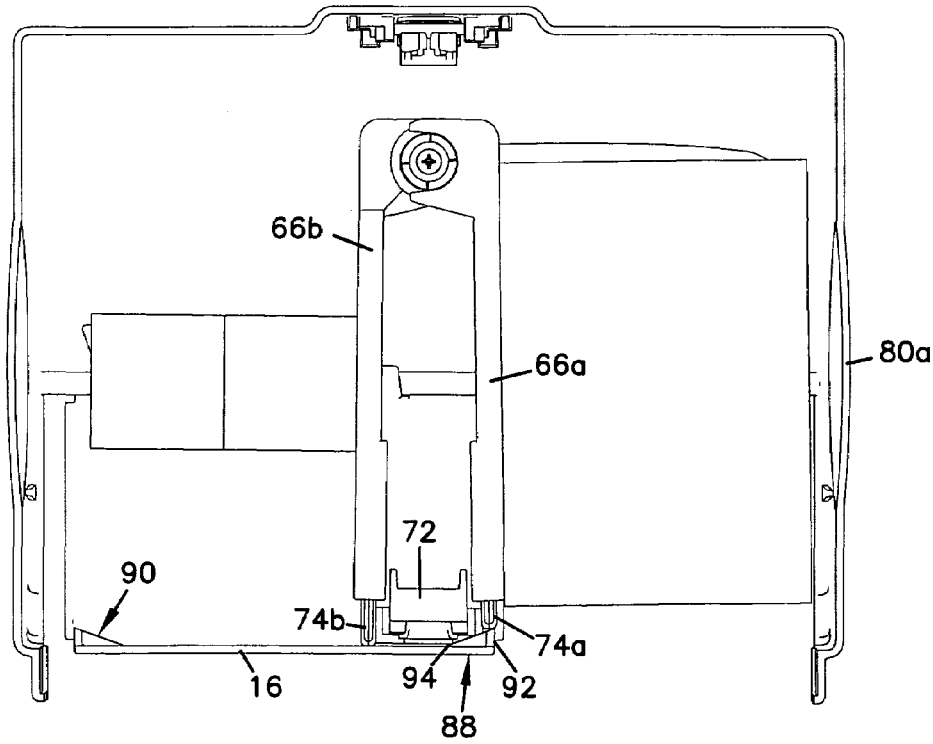
FIG. 11 is a view similar to FIG. 9, showing a third stage of transfer.

Once the stop 90 clears the tab 74*b*, the door 16 can continue to move toward the second door position. With reference to FIG. 11, which illustrates the final transfer stage for accessing the reserve roll, as the door 16 gets closer to the second door position, the stop 88 approaches the tab 74*a*. The ramp 94 of the stop 88 pushes the tab 74*a* upward into the arm 66*a* against the bias of the spring 76*a* (FIG. 2). As soon as the stop 88 passes under the tab 74*a*, the tab 74*a* snaps back into position behind the stop surface 92. The door 16 is then locked at the second door position, with the depleted roll covered by the door with the reserve roll now uncovered and becoming the dispensing roll ready for use. If the user tries to push the door back to the first door position, such movement will be prevented as discussed for the original dispensing roll.

With the reduced core rolls discussed above, the core section 86 will be prevented from being forced toward the core section 84 by tissue remaining on the roll. It is anticipated that about 3 to 6 feet of tissue left on the roll (approximately 1–2 uses) will allow the core section 86 to be forced toward the core section 84 a sufficient distance to allow transfer to the second roll. If the remaining tissue is greater than this amount, transfer may not be possible.

Figure 12:
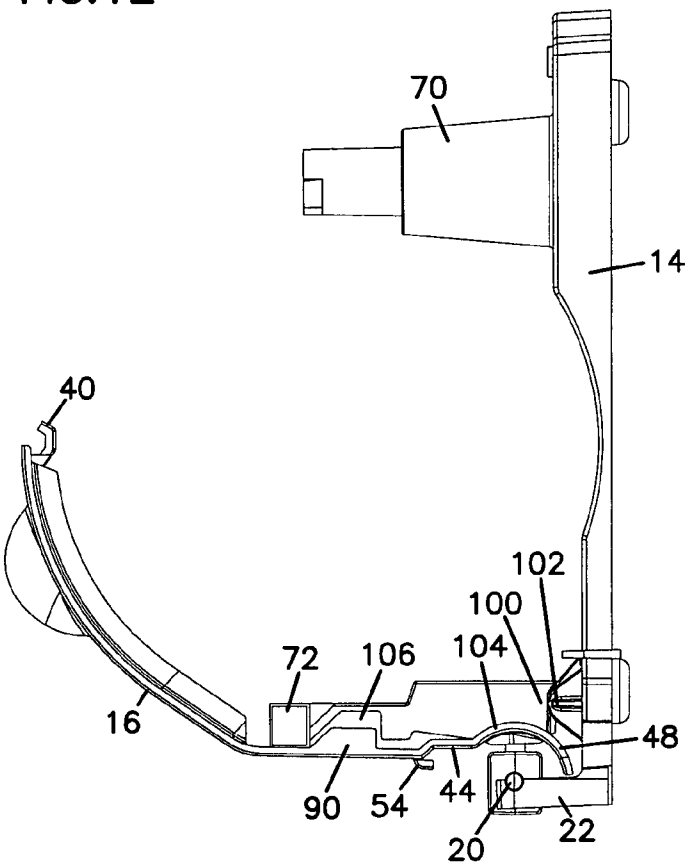
FIG. 12 illustrates the interaction between the door and the stop.

With reference to FIG. 12, a portion of the rear housing 14 is illustrated, along with the door 16 and stop 72. The stop 72 is pivotally connected at its back end 100 to the rear housing by pivot 102. In addition, the bottom of the stop 72 includes a curved surface 104 that is supported by the arcuate portion 48, and a slot 106 that is sized to receive the stops 88, 90 at the first and second door positions. As FIG. 12 illustrates, the stop 72 is supported by the door 16 to prevent the stop 72 from rotating downward about the pivot 102. Therefore, as long as the door 16 is present, the stop 72 is kept in position between the arms 66*a*, 66*b* to limit movement of the arms 66*a*, 66*b* toward each other and maintain the gap therebetween.

Figure 14:
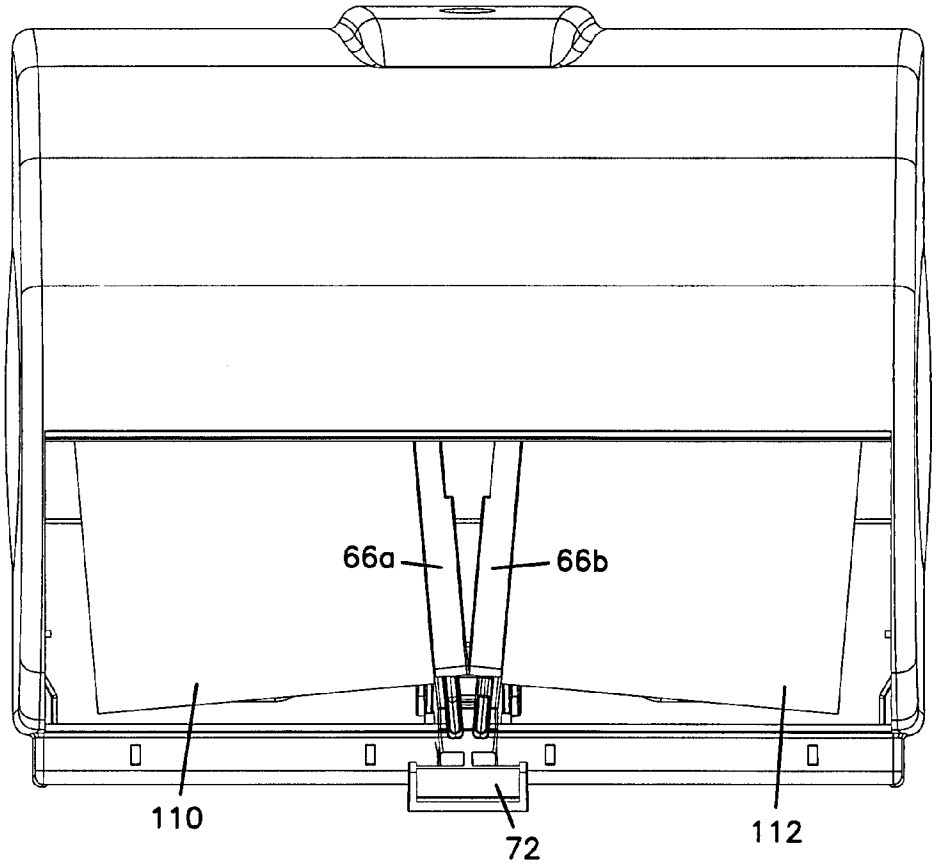
FIG. 14 is a front plan view of the dispenser with the door removed.
Figure 13:
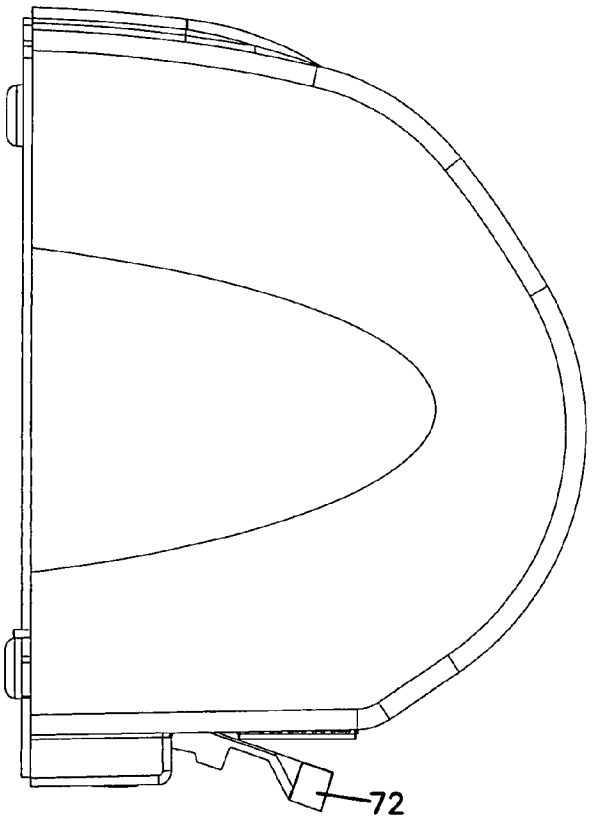
FIG. 13 is a side view of the dispenser with the door removed.

However, if the door 16 is removed, the support for the stop 72 is no longer present, and the stop 72 will pivot downward under the force of gravity. This is illustrated in FIGS. 13 and 14. By pivoting downward, the stop 72 is no longer positioned to limit movement of the arms 66*a*, 66*b* toward each other. As a result, the arms 66*a*, 66*b* will pivot into contact with each other. When this happens, the rolls 110, 112 will be held at an angle within the dispenser, as shown in FIG. 14. In this position, the edges of the rolls contact the end walls 80*a*, 80*b*.

When a user then tries to pull tissue from the tail end of one of the rolls, for example the roll on the left in FIG. 14, the pulling force will cause the arms 66*a*, 66*b* to swing counterclockwise. Likewise, if a user tries to pull tissue from the tail end of the right roll, the pulling force will cause the arms 66*a*, 66*b* to swing clockwise. When the arms 66*a*, 66*b* swing in one direction or the other, contact between the rolls and the end walls 80*a*, 80*b* increases, thereby making tissue dispensing difficult.

In an alternative embodiment, the stop 72 could be fixed to the rear housing 14 so that it cannot pivot relative to the rear housing. As a result, if the door 16 is removed, the stop 72 would remain in position between the arms 66*a*, 66*b* to limit movement of the arms 66*a*, 66*b* toward each other and maintain the gap therebetween.

In addition to reduced core rolls, the dispenser 10 could also operate with coreless rolls. However, coreless rolls are difficult to make to the diameter used in the dispenser 10 because they tend to get crushed and are difficult to load onto the mandrels. In addition, rolls having a core section missing from one or more ends of the rolls can also be used with the dispenser 10. Likewise, a narrow tissue roll (e.g. about 3 inches wide) could also be used with the dispenser 10.

The embodiments of the inventions disclosed herein have been discussed for the purpose of familiarizing the reader with novel aspects of the invention. Although preferred embodiments have been shown and described, many changes, modifications, and substitutions may be made by one having skill in the art without necessarily departing from the spirit and scope of the invention.

What is claimed is:

1. A dispenser configured to dispense paper web material from rolls of paper web material, comprising:

a housing having a front cover and a rear housing defining a housing interior, the front cover including opposite end walls, an opening that communicates the housing interior with the exterior of the dispenser, and a door slideably supported in a portion of the opening and slideable horizontally between a first door position and a second door position; and first and second roll support mechanisms disposed within the housing interior, each roll support mechanism includes a mandrel upon which a paper web material roll is to be supported, the mandrels extend in opposite directions in axial alignment with each other, and each mandrel has a free end tat projects toward a respective end wall of the front cover, and each mandrel is mounted for movement in a direction toward its respective end wall of the front cover.

2. The dispenser of claim 1, wherein each mandrel is pivotally mounted so as to be movable in an arc about a pivot axis.

3. The dispenser of claim 1, wherein each roll support mechanism further includes a mandrel arm that is pivotally mounted within the housing interior, and the mandrels are fixed to the mandrel arms.

4. The dispenser of claim 3, wherein the mandrel arms pivot about an axis that is generally perpendicular to the direction of movement of the door.

5. The dispenser of claim 4, wherein the door includes a surface that faces the housing interior, and further comprising first and second stops connected to the surface, the first and second stops are configured to engage the mandrel arms.

6. The dispenser of claim 3, wherein the mandrel arms extend from a common pivot axis at one end of the mandrel anns vertically downward to a connection point with the mandrels at an opposing end of the mandrel arms.

7. The dispenser of claim 1, wherein each mandrel is configured for movement independent of movement of the other mandrel.

8. The dispenser of claim 1, wherein the first and second roll support mechanisms are configured to rotate in opposite directions about a pivot axis.

9. The dispenser of claim 1, wherein the mandrels include a tapered end facing the respective end walls.

10. A dispenser configured to dispense a paper web material from reduced core paper web material rolls, each roll having a core formed by first and second spaced apart core sections, comprising:

a housing having a front cover and a rear housing defining a housing interior, the front cover including opposite end walls and an opening that communicates the housing interior with the exterior of the dispenser;

a door slideably supported in a portion of the opening and slideable horizontally between a first door position and a second door position; and first and second roll support mechanisms disposed within the housing interior, each roll support mechanism including a mandrel upon which a reduced core roll is able to be supported, the mandrels extend in opposite directions in axial alignment with each other, and each mandrel has a free end that projects toward a respective end wall of the front cover, and each mandrel is sized such that when a reduced core roll is disposed thereon, the second core section overhangs the free end of the mandrel, and each mandrel is mounted for movement in a direction toward its respective end wall of the front cover, whereby when a roll becomes depleted and a mandrel supporting the depleted roll moves toward the respective end wall, engagement between the second core section end the respective end wall forces the second core section toward the first core section.

11. The dispenser of claim 10, wherein each mandrel is pivotally mounted so as to be movable in an arc about a pivot axis.

12. The dispenser of claim 10, wherein each roll support mechanism further includes a mandrel arm that is pivotally mounted within the housing interior, and the mandrels are fixed to the mandrel arms.

13. The dispenser of claim 12, wherein the mandrel arms pivot about an axis that is generally perpendicular to the direction of movement of the door.

14. The dispenser of claim 13, wherein the door includes a surface that faces the housing interior, and further comprising first and second stops connected to the surface, the first and second stops are configured to engage the mandrel arms.

15. A method of dispensing paper web material from a two roll paper web material dispenser, comprising:

providing a two roll paper web material dispenser having a housing defining a housing interior and first and second roll support mechanisms disposed within the housing interior, each roll support mechanism including a mandrel upon which a reduced core paper web material roll is to be supported, the mandrels extend in opposite directions and each mandrel has a free end that projects toward a respective end wall of the housing, and each mandrel is mounted for movement in a direction toward its respective end wall of the housing;

disposing first and second reduced care paper web material rolls on the mandrels of the first and second roll support mechanisms, each roll having a core formed by first and second spaced apart core sections, with the second core section overhanging the free end of the respective mandrel, and one of the rolls being a dispensing roll and the other roll being a reserve roll;

dispensing paper web material from the dispensing roll until the dispensing roll is depleted;

moving the mandrel with the depicted roll thereon toward its respective end wall of the housing to cause engagement between the second core section and the end wall thereby forcing the second core section toward the first core section; and thereafter dispensing paper web material from the reserve roll.

16. The method of claim 15, wherein the dispenser further includes a door slideably supported in the housing, the method further comprising engaging the door with the roll support mechanism that includes the mandrel with the depleted roll to move the mandrel.

17. The method of claim 15, wherein moving the mandrel includes rotating the mandrel about a pivot axis that extends perpendicular to a longitudinal axis of the mandrel.

18. The method of claim 15, wherein the mandrels are independently movable in opposite directions from each other.

19. A dispenser configured to dispense paper web material from rolls of paper web material, comprising:

a housing having a front cover and a rear housing defining a housing interior, the front cover including opposite end walls, an opening that communicates the housing interior with the exterior of the dispenser, and a door slideably supported in a portion of the opening and slideable between a first door position and a second door position; and first and second roll support mechanisms disposed within the housing interior, each roll support mechanism includes a mandrel upon which a paper web material roll is to be supported and a mandrel arm that is pivotally mounted within the housing interior;

wherein the mandrels are fixed to the mandrel arms, the mandrels extend in opposite directions, each mandrel has a free end that projects toward a respective end wall of the front cover, each mandrel is mounted for movement in a direction toward its respective end wall of the front cover, and the mandrel arms pivot about an axis that is generally perpendicular to the direction of movement of the door;

wherein the door includes a surface that faces the housing interior, and further includes first and second stops connected to the surface, the first and second stops configured to engage the mandrel arms.

20. The dispenser of claim 19, wherein each mandrel is pivotally mounted so as to be movable in an arc about a pivot axis.

* * * * *

UNITED STATES PATENT AND TRADEMARK OFFICE

CERTIFICATE OF CORRECTION

PATENT NO. : 7,083,138 B2
APPLICATION NO. : 10/767707
DATED : August 1, 2006
INVENTOR(S) : Elliott et al.

It is certified that error appears in the above-identified patent and that said Letters Patent is hereby corrected as shown below:

Col. 8, line 38, claim 1: "free end tat projects" should read --free end that projects--

Col. 8, line 58, claim 6: "anns vertically" should read --arms vertically--

Signed and Sealed this

Twenty-third Day of January, 2007

JON W. DUDAS
*Director of the United States Patent and Trademark Office*